US005523733A

United States Patent [19]

Heritier-Best et al.

[11] Patent Number: 5,523,733

[45] Date of Patent: Jun. 4, 1996

[54] SECONDARY WINDING BOBBIN FOR AN IGNITION COIL FOR AN INTERNAL COMBUSTION ENGINE

[75] Inventors: Pierre Heritier-Best, Orbeil; Laurent Coste, Brioude, both of France

[73] Assignee: Sagem Allumage, France

[21] Appl. No.: 185,400

[22] Filed: Jan. 24, 1994

[30] Foreign Application Priority Data

Jan. 28, 1993 [FR] France ..... 93 00857

[51] Int. Cl.[6] ..... H01F 27/30

[52] U.S. Cl. ..... 336/185; 242/433; 336/208

[58] Field of Search ..... 336/198, 208, 336/185; 242/7.09, 613.2

[56] References Cited

U.S. PATENT DOCUMENTS

| | | | |
|---|---|---|---|
| 3,461,414 | 8/1969 | Fearon et al. | 336/208 |
| 3,661,342 | 5/1972 | Sears | 336/208 |
| 4,274,136 | 6/1981 | Onodera et al. | 336/208 |
| 4,387,863 | 6/1983 | Edmonston et al. | 242/118.4 |
| 4,862,130 | 8/1989 | Ellison | 336/198 |

FOREIGN PATENT DOCUMENTS

| | | | |
|---|---|---|---|
| 0320018 | 6/1989 | European Pat. Off. . | |
| 2754221 | 6/1979 | Germany | 336/208 |
| 278842 | 10/1927 | United Kingdom | 336/208 |
| 2171562 | 8/1986 | United Kingdom . | |

OTHER PUBLICATIONS

Japanese Patent Abstracts, Sadakichi Saruta, Appln. No. 57–111968, Apr. 1984.

Japanese Patent Abstract, Hiroshi Watanabe, Appln No. 57–150755, Jun. 1984.

*Primary Examiner*—Thomas J. Kozma

*Attorney, Agent, or Firm*—Dennison, Meserole, Pollack & Scheiner

[57] ABSTRACT

A secondary winding bobbin of an ignition coil for an internal combustion engine is disclosed. The bobbin includes tubular winding core and a plurality of fins substantially perpendicular to the axis of the core. The fins defining between them annular winding compartments of which the core forms the bottom. Each fin including a passage to allow the secondary winding wire to pass, in the winding direction, from the compartment located upstream of this fin to the compartment located downstream. The core has a shape such that the passage opens into the upstream compartment at a distance (e) from the bottom of the core and into the downstream compartment level with the core.

19 Claims, 7 Drawing Sheets

SECONDARY WINDING BOBBIN FOR AN IGNITION COIL FOR AN INTERNAL COMBUSTION ENGINE

FIELD OF THE INVENTION

The present invention relates to a secondary winding bobbin for an ignition coil for an internal combustion engine, and more particularly to such a bobbin of the type that includes a tubular winding core and a plurality of fins substantially perpendicular to the axis of the core, the fins defining between them annular winding compartments of which the core forms the bottom, and each including a passage to allow the secondary winding wire to pass through in the winding direction, from the compartment located upstream of this fin to the compartment located downstream.

BACKGROUND OF THE INVENTION

Secondary bobbins of this kind are known, for example from European Patent Application EP-A 0 375 502.

In internal combustion engines with controlled ignition, the combustion of the gaseous mixture in the cylinder is induced by the spark that is produced between the electrodes of a spark plug.

In order to produce this spark, the terminals of the spark plug are connected to the ends of the secondary (high-voltage) winding of a transformer, such as an ignition coil, whose primary winding is connected to a voltage source by way of a switch, such as a transistor.

With this switch closed, an electric current circulates in the primary winding. If at a given moment the switch is then opened, an abrupt overvoltage occurs in the primary winding, which by induction generates a voltage spike within the secondary winding. Once this voltage reaches a sufficient value, the spark is produced, causing the combustible mixture to ignite.

The voltage at the terminals of the secondary winding may be as high as several tens of thousands of volts. The aforementioned fins, by defining separate winding compartments, make it possible to limit the risk of a spark developing between two turns of this winding. In fact, the voltage between the starting turn and the ending turn of the same compartment is limited to several thousand volts, in the typical case where the number of compartments is on the order of about 10.

Nevertheless, the beginning and end of a compartment is formed by a slot in which each of the fins define this compartment, and so the voltage between two turns located facing one another on either side of this slot in two adjacent compartments still remains on the order of several thousand volts, so that the risks that a spark may develop are nevertheless not completely averted.

The aforementioned document proposes to overcome this disadvantage by providing insulating compartments between the winding compartments in such a way as to increase the distance between the turns of two successive winding compartments.

Such an arrangement nevertheless has the disadvantage of increasing the axial size of the secondary bobbin, and consequently of the ignition coil that includes it.

SUMMARY OF THE INVENTION

The present invention seeks to overcome this disadvantage.

To that end, the subject of the invention is a secondary winding bobbin of an ignition coil for an internal combustion engine, of the type including a tubular winding core and a plurality of fins substantially perpendicular to the axis of the core, the fins defining between them annular winding compartments of which the core forms the bottom, and each including a passage to allow the secondary winding wire to pass, in the winding direction, from the compartment located upstream of this fin to the compartment located downstream, characterized in that said core has a shape such that said passage opens into the upstream compartment at a certain distance from said core and into the downstream compartment at the level of said core.

Hence at the level of the passage, the windings of two adjacent compartments are staggered, in such a way that it is possible to limit the voltage between two turns located facing one another.

In particular, the passage may be constituted by the bottom of a slot extending from the edge of the fin.

More particularly, the bottoms of two adjacent compartments may be radially offset from the level of said passage by a distance equal to the thickness of one winding.

In other words, the secondary winding wire, at the time of the passage from the upstream compartment to the downstream compartment, is routed from the upper level of the winding to a lower level.

In that case, only the last winding turns of the upstream compartment are located face to face with the first turns of the downstream compartment, such that there is virtually no potential difference whatever at the level of the passage slot.

In a particular embodiment of the invention, the core has a generally rectangular cross section, said passage being formed in an angle of the core, and the corresponding angle of the upstream compartment being cut.

Other geometries are possible, the essential point being that the bottoms of two adjacent compartments are not superimposed completely in projection on one another, so as to allow the passage of the wire from a certain level of the upstream compartment to the bottom of the downstream compartment. The bottoms of the compartments may in particular be identical and in projection, between two adjacent compartments, may be staggered in their plane or angularly about their axis.

Hence the bottoms of two adjacent compartments may be eccentrically circular or elliptical with angularly staggered long axes, or rectangular and staggered in their plane parallel to one of their sides or to their diagonal, or rectangular with their diagonals angularly staggered.

It may also be provided that the starting passage in a compartment be staggered angularly from its ending passage.

The starting and ending passages may in particular be diametrically opposed.

A particular embodiment of the invention will now be described by way of non-limiting example, in conjunction with the accompanying drawings.

DESCRIPTION OF THE PREFERRED EMBODIMENT

Figure 1:
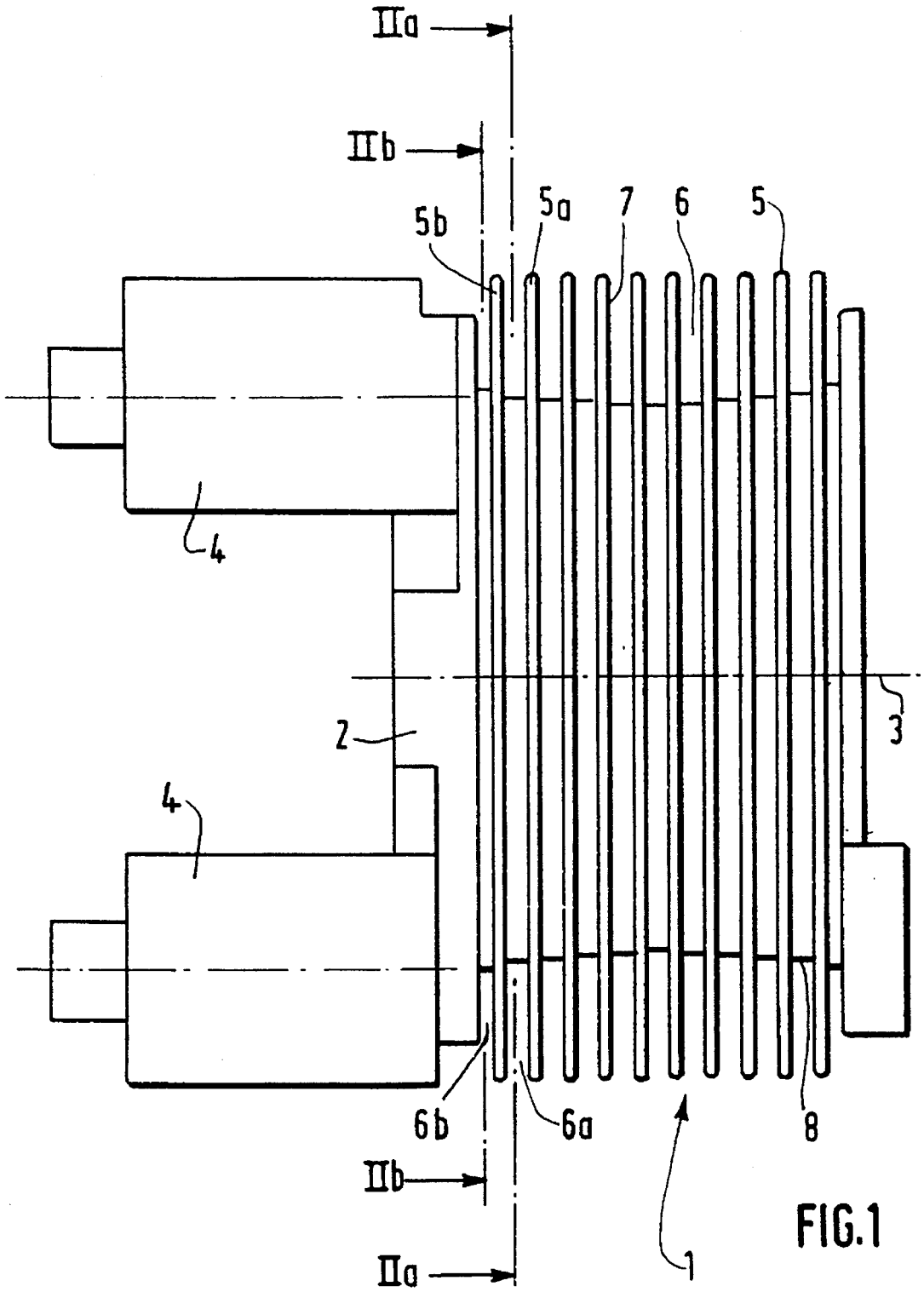
FIG. 1 is a side view of a secondary bobbin according to the invention.
Figure 2:
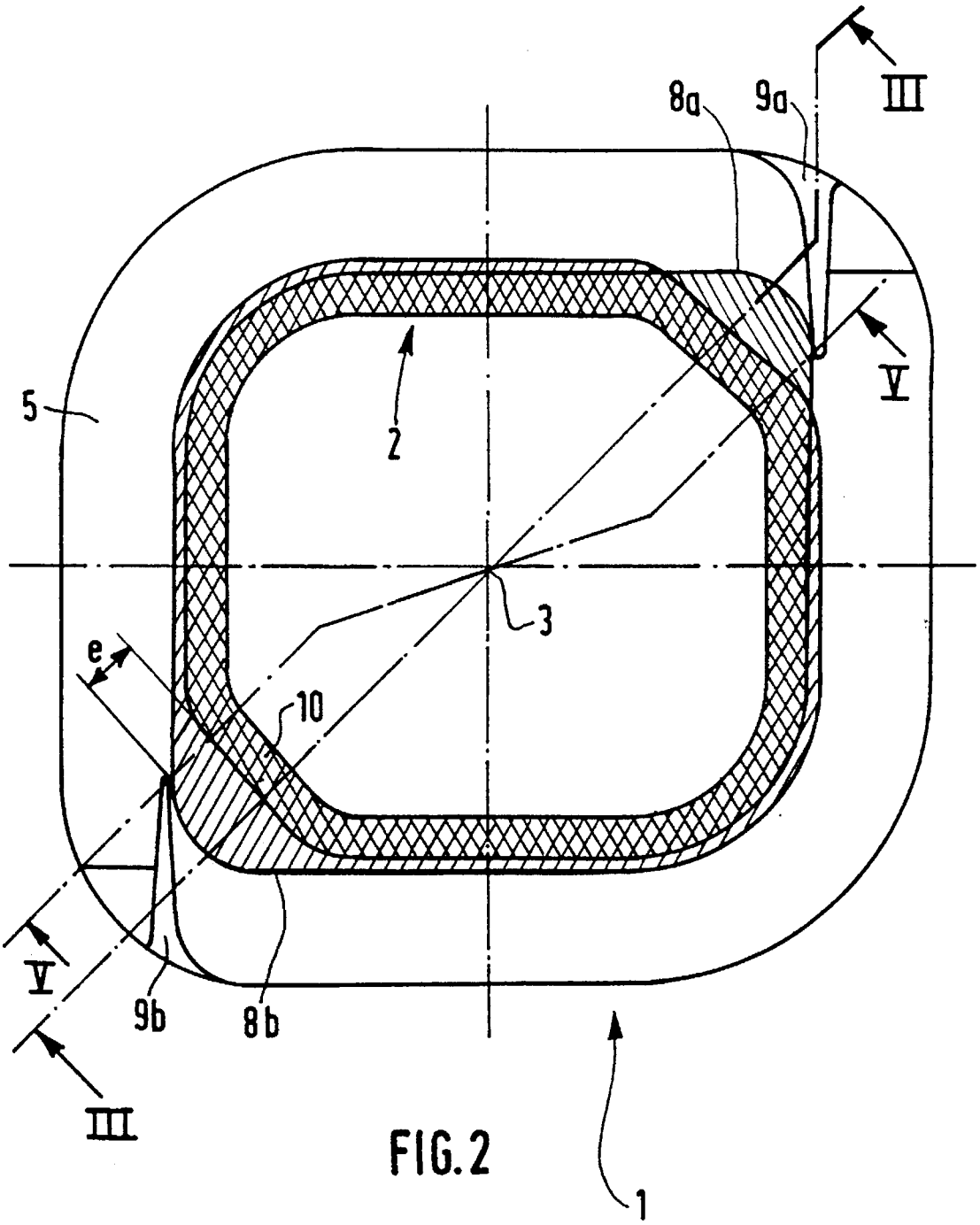
FIG. 2 is a superposition, intended to provide better comprehension of the invention, of sectional views taken along the lines II*a*—II*a* and II*b*—II*b* of FIGS. 1 and 3.
Figure 3:
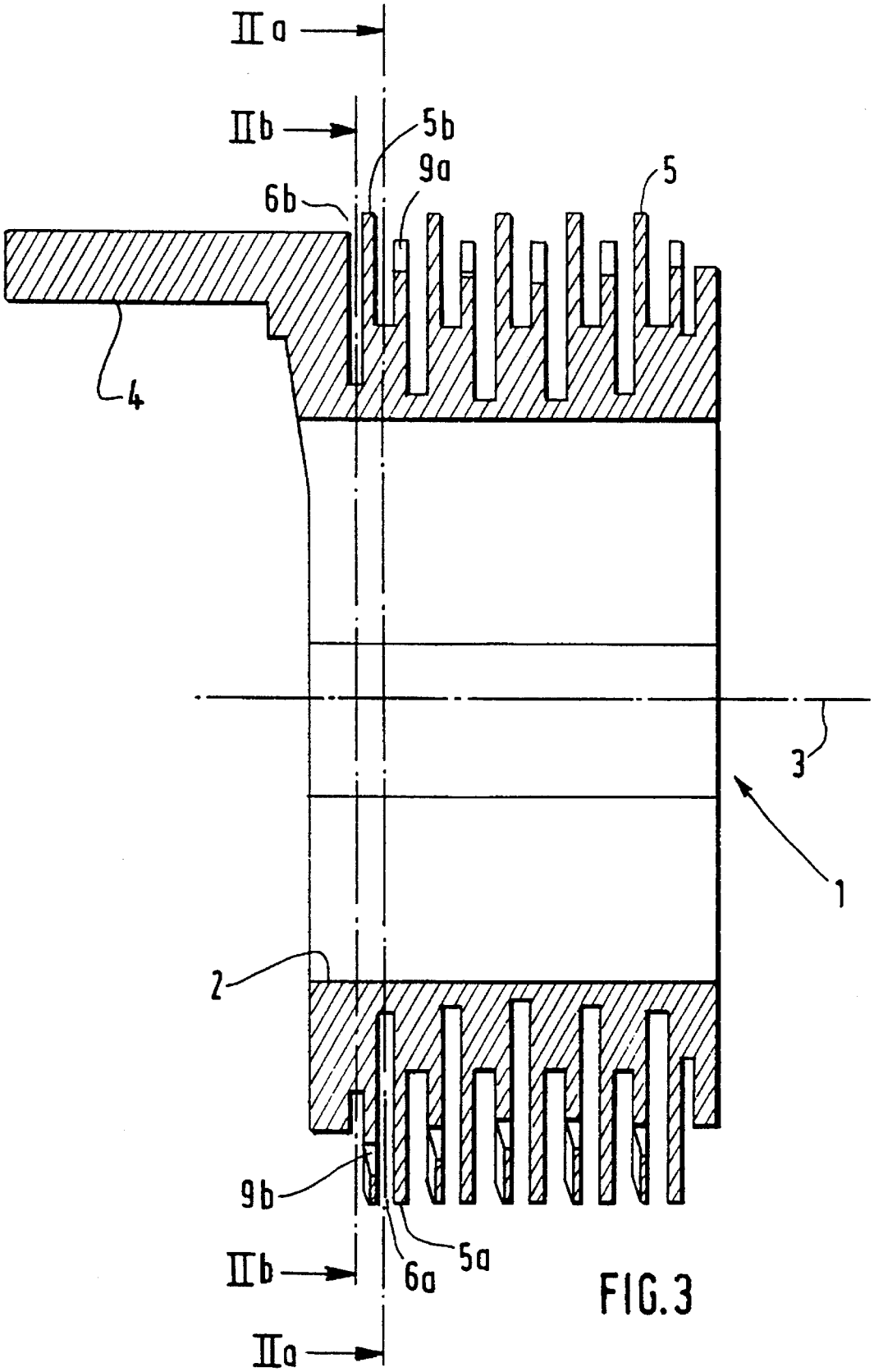
FIG. 3 is an axial sectional view taken along the line III—III of FIG. 2.

In FIGS. 1–3, the secondary bobbin 1 of an ignition coil of an internal combustion is seen, formed of a tubular core 2 with an axis 3 and made in a known manner of plastic insulating material. The mounting and connection devices 4 of the bobbin are made in one piece with the core 2.

In addition, fins 5 perpendicular to the axis 3 define between them winding compartments 6. Each compartment 6 accordingly forms a throat in which the lateral walls 7 are formed by the two fins that define this compartment, and whose bottom 8 is formed by the core 2.

The winding is effected from one compartment to the next, from right to left in FIG. 1. Consequently, the fin 5*b* of FIG. 1 separates its upstream compartment 6*a*, located to its right, from its downstream compartment 6*b*, located to its left.

As can be seen in FIG. 2, the bobbin 1 and in particular its core 2 have a substantially rectangular shape.

This figure also shows how the passage of the winding wire from one compartment to another is done via slots 9*a* and 9*b* that extend from the edge of the fins and are substantially tangent to the core. More particularly, this figure shows the slot 9*a* formed in the fin 5*a*, to allow the entry into the compartment 6*a*, and the slot 9*b* formed in the fin 5*b*, to allow the passage of the wire from compartment 6*a* to compartment 6*b*. The slot 9*a* is tangent to the bottom 8*a* of compartment 6*a* and arrives at the level of this bottom, and similarly the slot 9*b* is tangent to the bottom 8*b* of the compartment 6*b* and also arrives level with this bottom.

It is also seen in FIG. 2 that at the end of the slot 9*b* for passage from compartment 6*a* to compartment 6*b*, the core bottom 8*a* of compartment 6*a* has its angle 10 cut, in such a way that at this angle 10, the end of the slot 9*b* extends a certain distance e from the bottom 8*a* of the compartment 6*a*.

Figure 4:
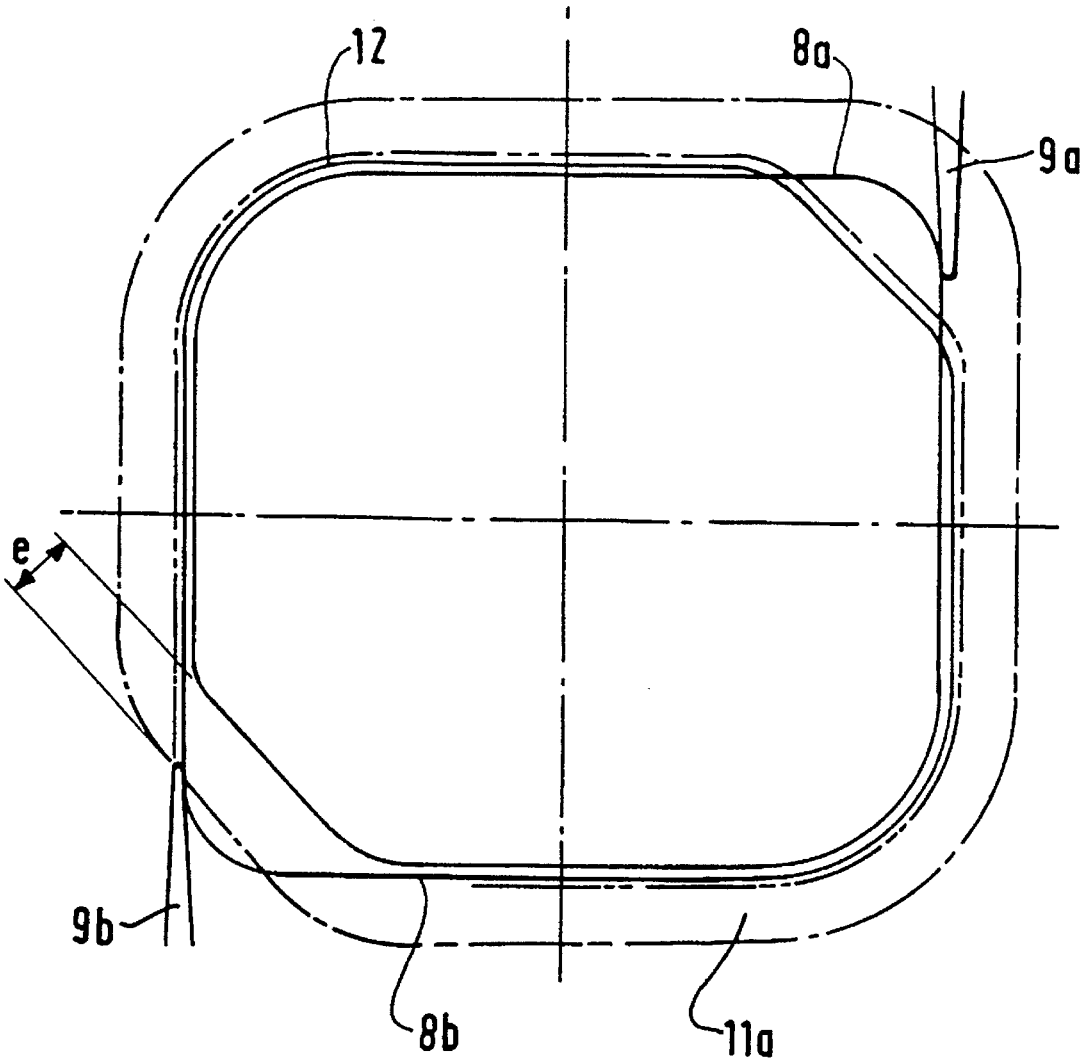
FIG. 4 is a diagram in axial view of the winding in a winding compartment.

FIG. 4 shows only the bottoms 8*a* and 8*b* of compartments 6*a* and 6*b*, the slots 9*a* and 9*b*, the winding 11*a* in compartment 6*a*, and the first winding turn 12 in compartment 6*b*. It can also be seen from this figure that the distance e equals the thickness of the winding 11*a*. Consequently, the first winding turn 12 in compartment 6*b* is face-to-face, at the level of the slot 9*b*, with the last winding layer in compartment 6*a*, such that there is no difference whatever in potential between the windings in the two compartments in the level of this slot.

FIGS. 5*a*–5*d*, which in simplified fashion represent sections taken along a line such as V—V of FIG. 2, illustrate the winding of a wire 20 whose diameter will be equal to the thickness of a compartment 6 and which accordingly actually schematically represents several winding layers.

Figure 5B:
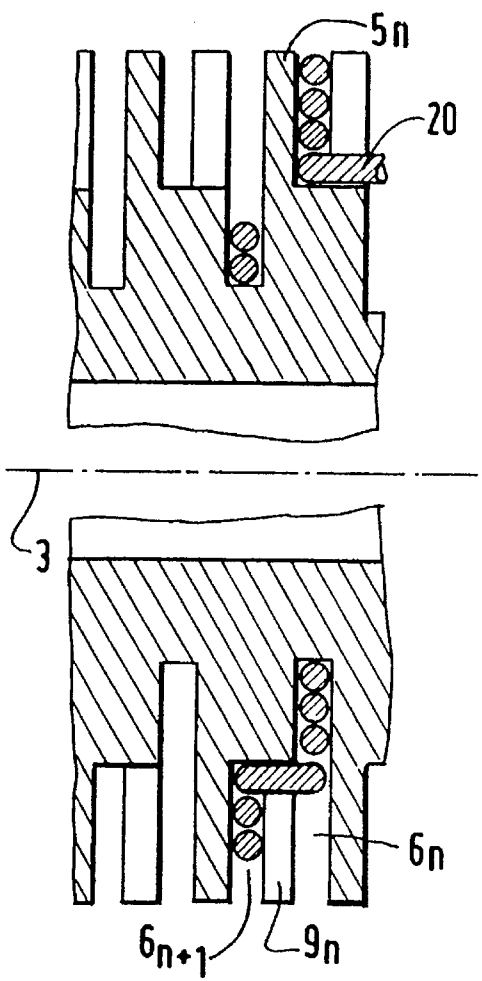
FIGS. 5*a*–5*d* illustrate the passage of the wire in the successive winding compartments.
Figure 5A:
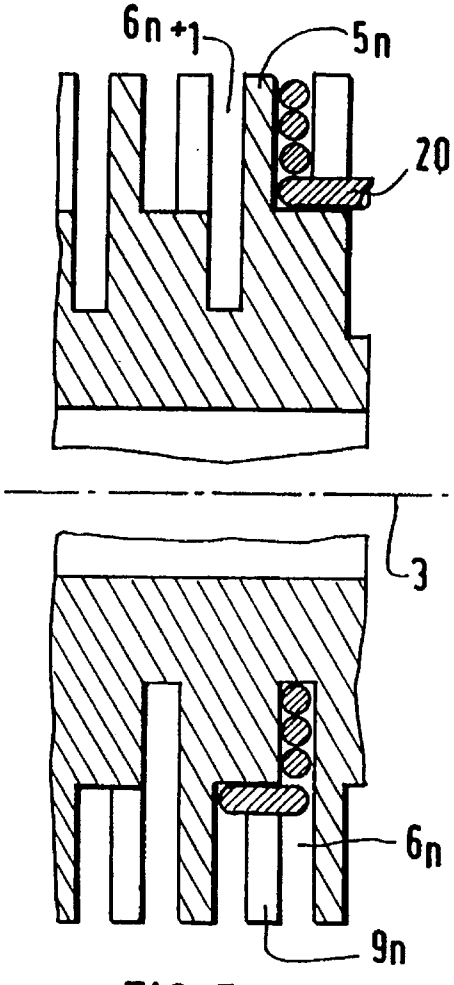

FIG. 5*a* shows the wire 20 filling a compartment $\mathbf{6}_n$ and penetrating the compartment $\mathbf{6}_{n+1}$, crossing the slot $\mathbf{9}_n$ formed in the fin $\mathbf{5}_n$.

Filling of the compartment $\mathbf{6}_{n+1}$ by the wire 20 is done as shown in FIG. 5*b*. This figure shows that no potential difference whatever exists at the level of the slot $\mathbf{9}_n$ between the winding in the compartment $\mathbf{6}_n$ and the winding in the compartment $\mathbf{6}_{n+1}$.

Figure 5D:
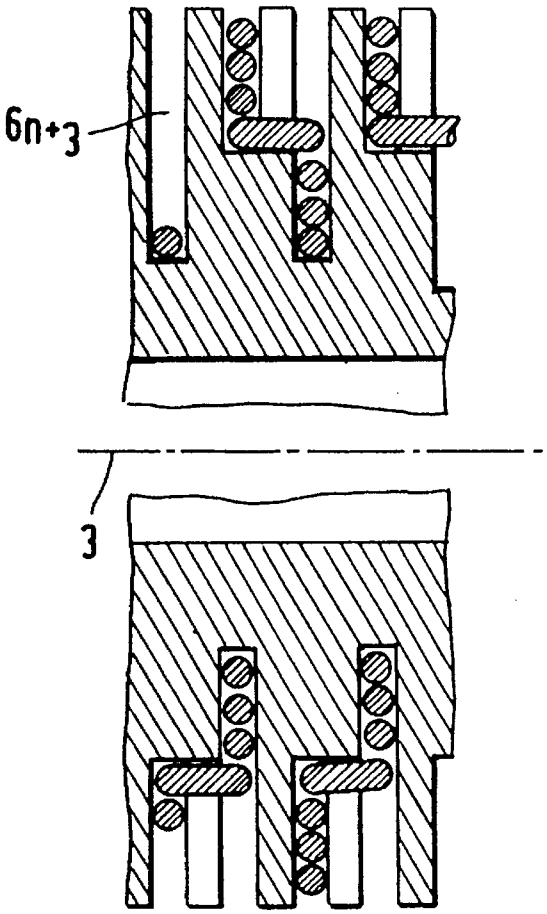
Figure 5C:
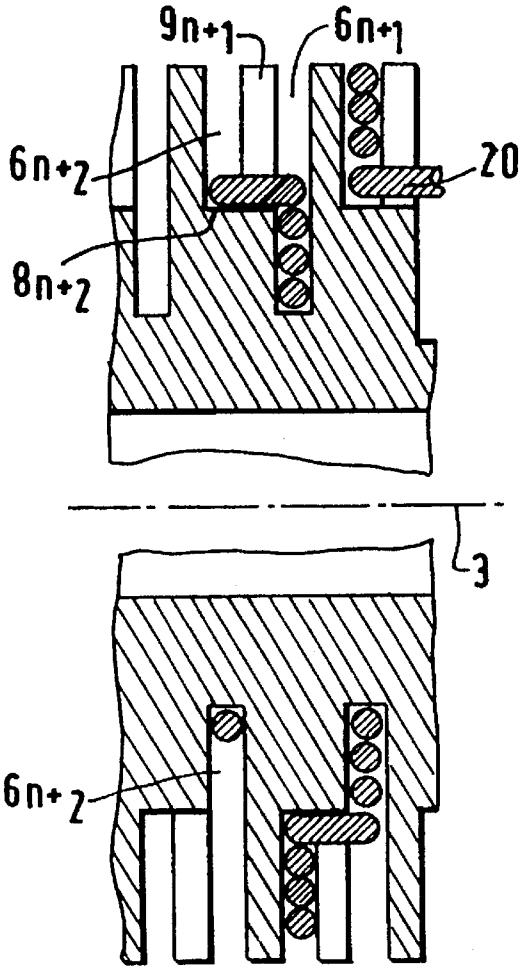

When the winding in this compartment $\mathbf{6}_{n+1}$, in the angular zone of the slot $\mathbf{9}_{n+1}$ of the fin $\mathbf{5}_{n+1}$, arrives at the level of the bottom $\mathbf{8}_{n+2}$ of the compartment $\mathbf{6}_{n+2}$, the wire 20 crosses this slot, and the winding process in the compartment $\mathbf{6}_{n+2}$ has begun, as shown in FIG. 5*c*.

The winding thus continues one compartment at a time, with FIG. 5*d* showing the winding in the next compartment $\mathbf{6}_{n+3}$.

FIGS. 6–10 show other embodiments and are similar to FIG. 2, except that only the bottoms of the compartments have been shown, the passages from one compartment to another being illustrated by arrows.

Figure 6:
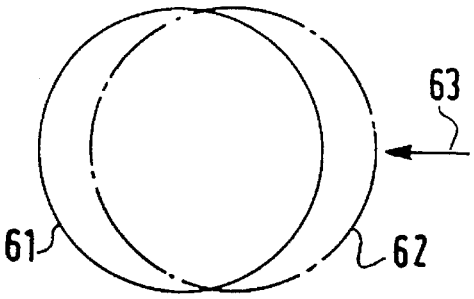
FIG. 6–10 are figures similar to FIG. 2, illustrating variant embodiments.

In FIG. 6, the bottoms of the compartments are circular, and the bottoms 61 and 62 of upstream and downstream compartments, respectively, are staggered in their plane. The passage from the upstream compartment to the downstream compartment takes place at the level of the arrow 63, and the passage to the next following compartment is diametrically opposed.

Figure 7:
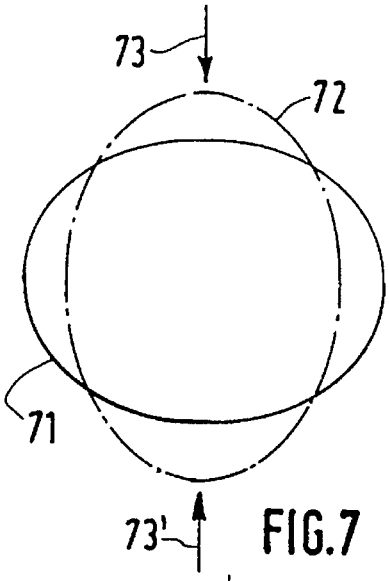

In FIG. 7, the bottoms 71 and 72 of the upstream and downstream compartments form ellipses whose long axes are perpendicular, and the passage from the upstream compartment to the downstream compartment takes place at the level of one of the arrows 73 or 73'. The passage to the next following compartment is offset here by 90° from the one preceding it.

Figure 8:
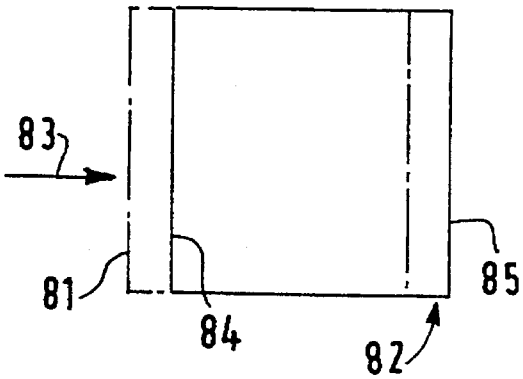

In the case of FIG. 8, the bottoms 81 and 82 of the upstream and downstream compartments are square and are staggered in their plane parallel to one of their sides. The passage from the upstream compartment to the downstream compartment takes place at the level of the arrow 83, in the zone of the middle of the staggered sides 84. The passage to the next following compartment takes place in the zone of the side 85 opposite the side 84.

Figure 9:
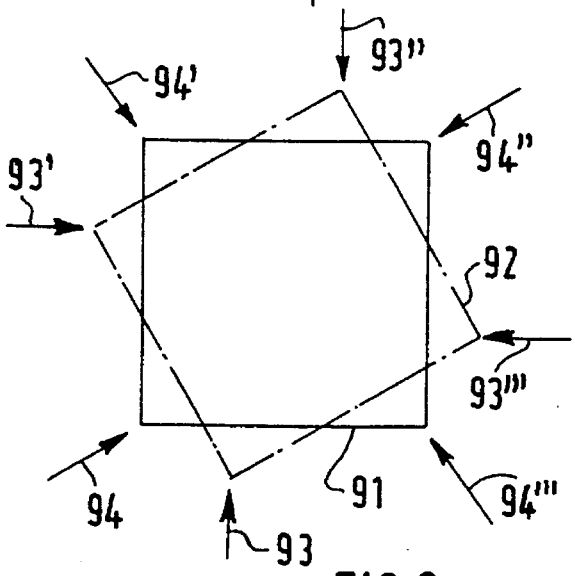

FIG. 9 also shows the embodiment where the bottoms 91 and 92 of the upstream and downstream compartments are square, but here, they are angularly staggered by rotation in their plane about their axis. The passage from the upstream to the downstream compartment takes place at the level of one of the arrows 93, 93', 93", 93''', and the passage to the next following compartment takes place at the level of one of the arrows 94, 94', 94", 94'''.

Figure 10:
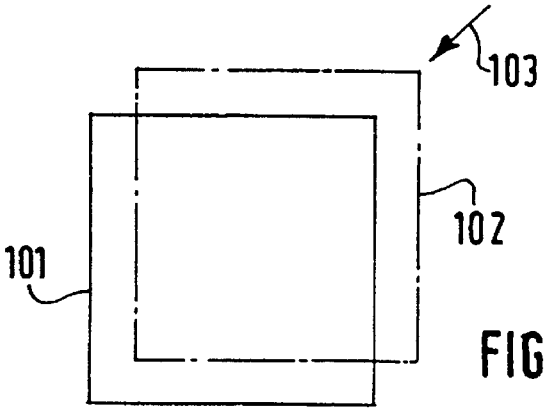

Finally, in the embodiment of FIG. 10, the bottoms 101 and 102 of the upstream and downstream compartments, respectively, are still square but are staggered in their plane parallel to one of their diagonals. The passage from the upstream compartment to the downstream compartment takes place at the level of the arrow 103, and the passage to the next following compartment is offset by 180°.

What is claimed is:

1. A secondary winding bobbin of an ignition coil for an internal combustion engine, comprising a tubular winding core having an axis and a plurality of fins substantially perpendicular to the axis of the core, pairs of adjacent fins defining between them respective annular winding compartments, the core forming bottoms of the annular winding compartments, each fin including a passage to allow a secondary winding wire to pass, in the winding direction, from an upstream compartment located upstream of said each fin to a downstream compartment located downstream of said each fin, wherein said passage comprises a slot having an interior contour which is uniformly parallel to the axis of the core and extending from said upstream compartment to said downstream compartment, and wherein said core has a shape such that the bottoms of said upstream compartments are staggered relative to the bottoms of said downstream compartments, and said passage opens into the upstream compartment at a point located a predetermined distance above said core and into the downstream compartment at a point level with said core.

2. The bobbin of claim 1, wherein the bottoms of two adjacent compartments are radially offset from an end of said passage by the predetermined distance, the predetermined distance being equal to a thickness of one winding.

3. The bobbin of claim 1, wherein said core has a substantially rectangular cross section with rounded corners, said passage being formed at a corner of the core, and a corresponding corner of the upstream compartment being configured at an oblique angle to provide said predetermined distance.

4. The bobbin of claim 1, wherein the bottoms of two adjacent compartments form nonconcentric and substantially identical circles.

5. The bobbin of claim 1, wherein the bottoms of two adjacent compartments form substantially identical ellipses having long axes which are are angularly staggered.

6. The bobbin of claim 1, wherein the bottoms of two adjacent compartments form two substantially identical rectangles having planes which are staggered.

7. The bobbin of claim 1, wherein the bottoms of two adjacent compartments form substantially identical rectangles having diagonals which are are angularly staggered.

8. The bobbin of claim 1, wherein a starting passage in a compartment is staggered angularly from an ending passage in said compartment.

9. The bobbin of claim 8, in which said starting and ending passages are diametrically opposed.

10. A secondary winding bobbin of an ignition coil for an internal combustion engine, comprising a tubular winding core having an axis and a plurality of fins substantially perpendicular to the axis of the core, the fins defining between them annular winding compartments, the core forming bottoms of the annular winding compartments, each fin including a passage to allow a secondary winding wire to pass, in the winding direction, from an upstream compartment located upstream of said each fin to a downstream compartment located downstream of said each fin, wherein said core has a substantially rectangular cross section with rounded corners and said passage is formed in a tangential direction at one of said rounded corners, said one of said rounded corners being configured to form an oblique angle so that said passage opens into the upstream compartment at a point located a predetermined distance above said core and into the downstream compartment at a point level with said core.

11. The bobbin of claim 1, wherein each of said passages serves as an exit passage for the secondary winding wire leaving the upstream compartment, and as an entrance passage for the secondary winding wire entering the downstream compartment.

12. The bobbin of claim 11, wherein each compartment has an entrance passage located on an upstream side thereof and an exit passage located on a downstream side thereof.

13. The bobbin of claim 12, wherein said entrance passage is located on one side of said axis of said tubular winding core, and said exit passage is located on an opposite side of said axis of said tubular winding core.

14. The bobbin of claim 12, wherein the entrance passages of adjacent compartments are on opposite sides of said axis of said tubular winding core.

15. The bobbin of claim 12, wherein the exit passages of adjacent compartments are on opposite sides of said axis of said tubular winding core.

16. The bobbin of claim 11, wherein said entrance passage is located on one side of said axis of said tubular winding core, and said exit passage is located on an opposite side of said axis of said tubular winding core.

17. The bobbin of claim 11, wherein the entrance passages of adjacent compartments are on opposite sides of said axis of said tubular winding core.

18. The bobbin of claim 1, wherein said plurality of fins comprises at least three fins.

19. The bobbin of claim 10, wherein said plurality of fins comprises at least three fins.

* * * * *